United States Patent [19]

Barnett et al.

[11] Patent Number: 4,678,095

[45] Date of Patent: Jul. 7, 1987

[54] COLLAPSIBLE CONTAINER

[75] Inventors: Earl D. Barnett, Glenview; Robert W. Mundstock, Schaumburg, both of Ill.

[73] Assignee: Chicago Show Printing Co., Morton Grove, Ill.

[21] Appl. No.: 858,685

[22] Filed: May 2, 1986

[51] Int. Cl.[4] ..... B05D 5/36

[52] U.S. Cl. ..... 220/4 F; 229/41 C; 229/45 R

[58] Field of Search ..... 220/4 F, 4 B, 4 E, 6; 229/41 C, 43, 45 R, 110, 22, 41 B

[56] References Cited

U.S. PATENT DOCUMENTS

| | | | |
|---|---|---|---|
| 1,112,642 | 10/1914 | Morgenstern | 229/22 |
| 2,163,017 | 6/1939 | Berch | 229/45 R X |
| 2,332,642 | 10/1943 | Johnson | 40/154 |
| 3,027,062 | 3/1962 | Huss et al. | 229/45 R X |
| 3,361,323 | 1/1968 | Adams et al. | 229/45 R X |
| 3,447,672 | 6/1969 | Bailey et al. | 229/45 R X |
| 3,465,944 | 9/1969 | Robinson | 229/45 R X |
| 4,166,567 | 9/1979 | Beach, Jr. et al. | 229/45 R X |
| 4,248,901 | 2/1981 | Austin | 426/119 |
| 4,279,933 | 7/1981 | Austin | 426/124 |
| 4,362,266 | 12/1982 | Webinger | 229/33 |
| 4,453,665 | 6/1984 | Roccaforte et al. | 229/41 C X |
| 4,534,505 | 8/1985 | Montealegre | 229/41 C |

*Primary Examiner*—Steven M. Pollard

*Attorney, Agent, or Firm*—Jones, Day, Reavis & Pogue

[57] ABSTRACT

A one piece collapsible container that can be stored and shipped in a flat state is disclosed. The container has top and bottom panels of polygonal shape and side panels hingedly connected therebetween. Each side panel comprises an upper and lower trapezoidal shaped panel, the panels hingedly connected together base to base, so that when the container is collapsed, the panels fold together. The panels are designed so that the adjacent opposite panels overlap the adjacent sides sealing the corner between the sides. The overlapping panels are furnished with interlocking tabs so as to secure the sides together when the container is assembled. The interior of the container has concealed tabs so strengthening bands may be provided between adjacent sides.

5 Claims, 5 Drawing Figures

COLLAPSIBLE CONTAINER

BACKGROUND OF THE INVENTION

This invention relates to collapsible containers that can be used to store and display small articles. Specifically it is directed to such containers that can be stored and shipped in a flat, disassembled state and may be easily assembled with a minimal amount of effort and without the use of separate fasteners.

Small containers are often seen by supermarket or restaurant cash registers holding small goods, such as pieces of candy or matchbooks, for sale or for complimentary distribution. Often advertising is printed on one or more sides of the container. Such containers, while relatively economical to manufacture, are not particularly well designed for either storage or shipping to their final destination for use. If shipped fully assembled, then shipping and storage is relatively expensive and burdensome because of the amount of space each unit takes up.

It is accordingly an object of this invention to provide a collapsible container that can be shipped and stored in a relatively flat state for shipping and storage and be readily assembled with a minimal amount of effort and without the need for applying fasteners to its outside surface.

A further object of this invention is to provide a collapsible container that can resist excessive wear without becoming disassembled.

Another object of this invention is to provide a collapsible container that can be assembled into an aesthetically pleasing object.

A still further object of this invention is to provide a collapsible container that is relatively economical to produce.

Other objects and advantages of the invention will be apparent from the remaining portion of the description.

DETAILED DESCRIPTION

Figure 1:
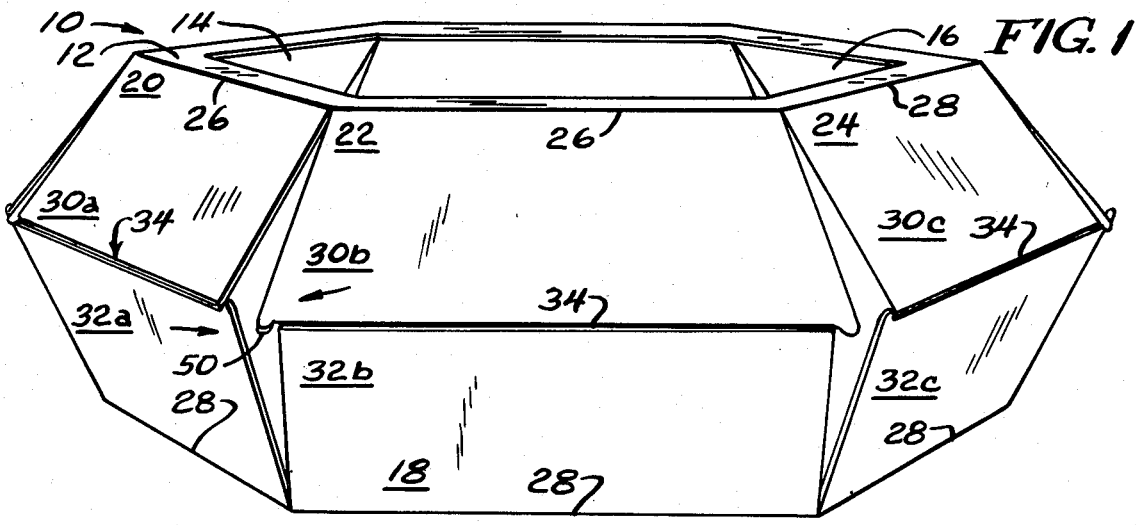
FIG. 1 is a perspective view of the assembled container according to a preferred embodiment of this invention.

Referring to FIG. 1, the assembled collapsible container 10, comprised of plastic or other flexible material, is illustrated. The container comprises a top panel 12, with an opening 14 to provide access to the interior of the container 16, a bottom panel 18, and a plurality of sides 20, 22, 24 therebetween. In the preferred embodiment of the invention the container is six-sided. In the preferred embodiment the top and bottom panels are of an equilateral shape and have the same cross-sectional area.

Figure 2:
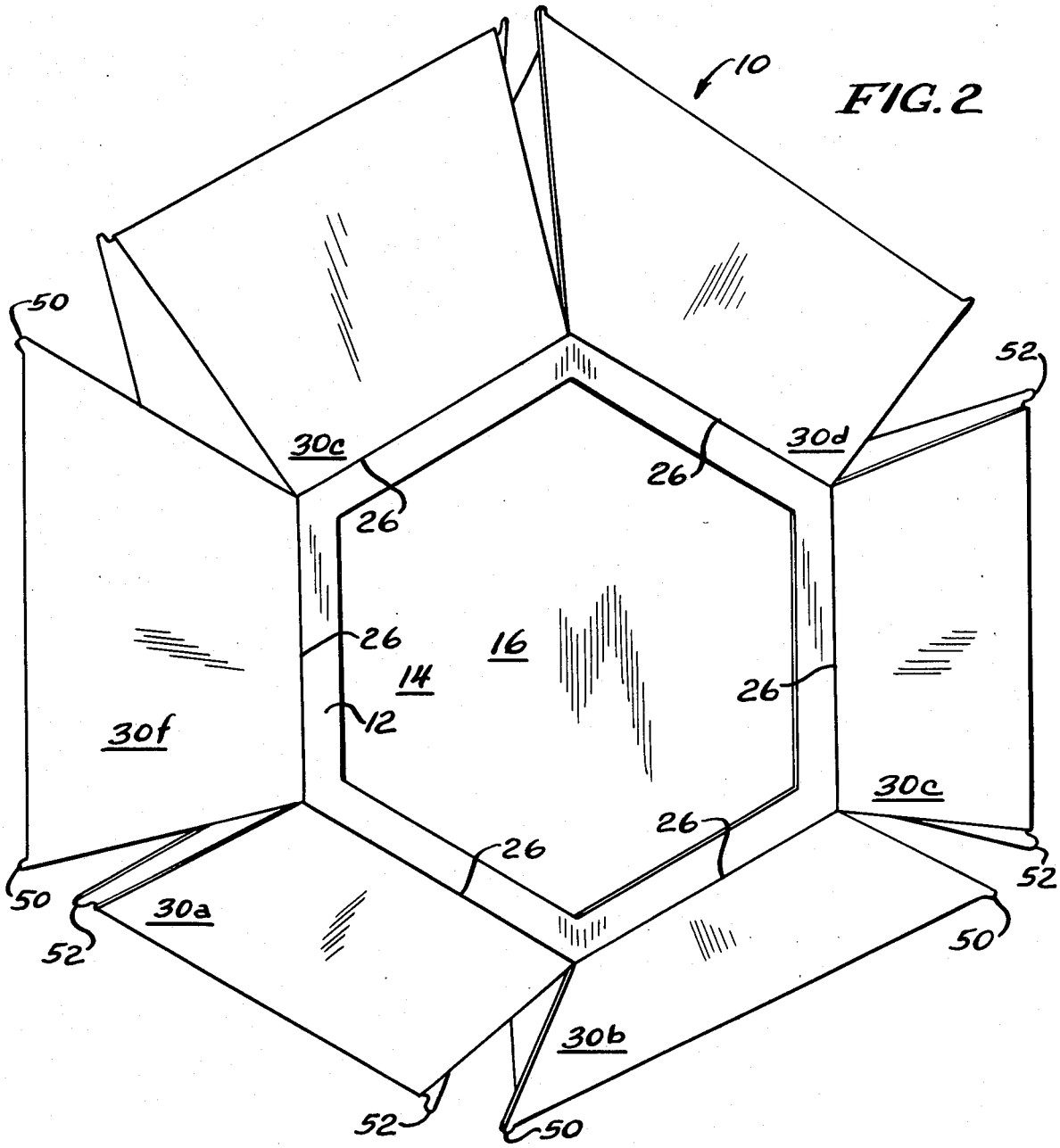
FIG. 2 is a perspective view of the container in its collapsed state.

The sides 20, 22, 24 are each hingedly connected to the top and bottom panels 12 and 18 along score lines 26 and 28, respectively, and are each comprised of a top section and a bottom section here 30*a, b, c* and 32 *a, b, c,* respectively. The top and bottom sections are hingedly connected together along score lines 34 so that when the container top and bottom panels are compressed together, the side sections fold outwardly turning the container into a relatively flat, two dimensional piece (see FIG. 2). The top and bottom side panels are also dimensioned so that when the container 10 is expanded into its fully assembled state, the adjacent and opposite panels overlap so as to close the container at the location the sides meet. For example, in the embodiment of the invention illustrated, the left edge of top section 30*b* of side 22 extends beyond the right edge of top section 30*a* of side 20, and the right edge of bottom section 32*a* extends beyond the left edge of bottom section 32*b* of side 22.

The corner of top panel 30*b* of side 22 that extends beyond the edge of the top panel of side 20 is provided with a downward extendng tab 50, and the corner of bottom section 32*a* of side 20 that extends beyond the bottom panel 32*b* of side panel 22 is provided with an upward extending tab 52. When the container 10 is fully assembled these tabs are spaced so as to interlock and secure the adjacent sides of the container. Pressure on the container causes the tabs to release so the container can be pressed flat for storage; expanding the container to its assembled state causes the tabs to interlock.

Figure 3:
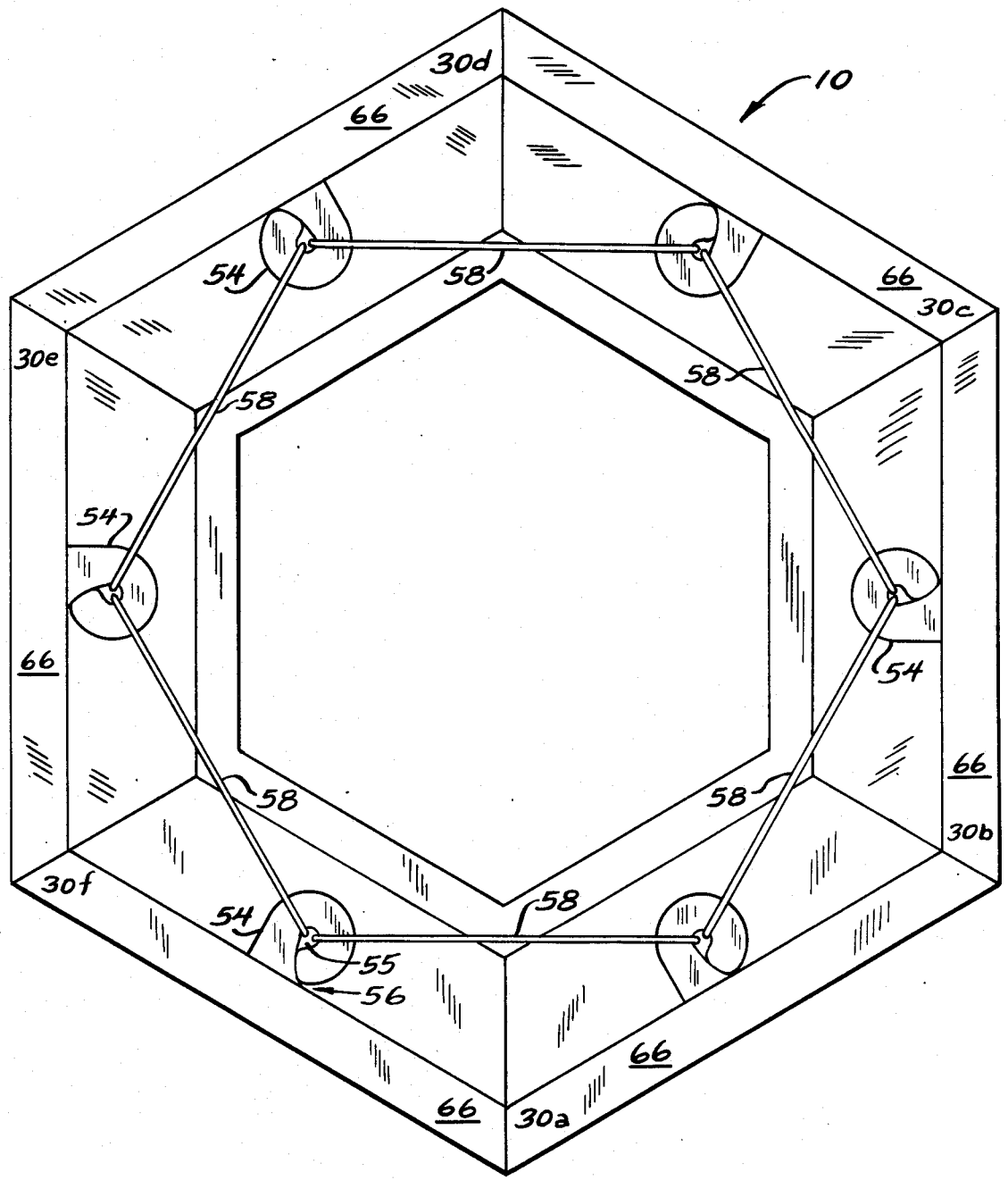
FIG. 3 is a cutaway view of the interior of the assembled container.

As indicated in FIG. 3, the interior of each top panel may be provided with an eyelet tab 54 just above the score line 34 having a center bore 55 and an access cut 56. These tabs permit a rubber band 58 to be strung between each side section so as to provide a lateral force to keep the sides 20, 22, 24 from separating. This arrangement is optional in view of the primary locking mechanism: the interlocking tabs.

Figure 4:
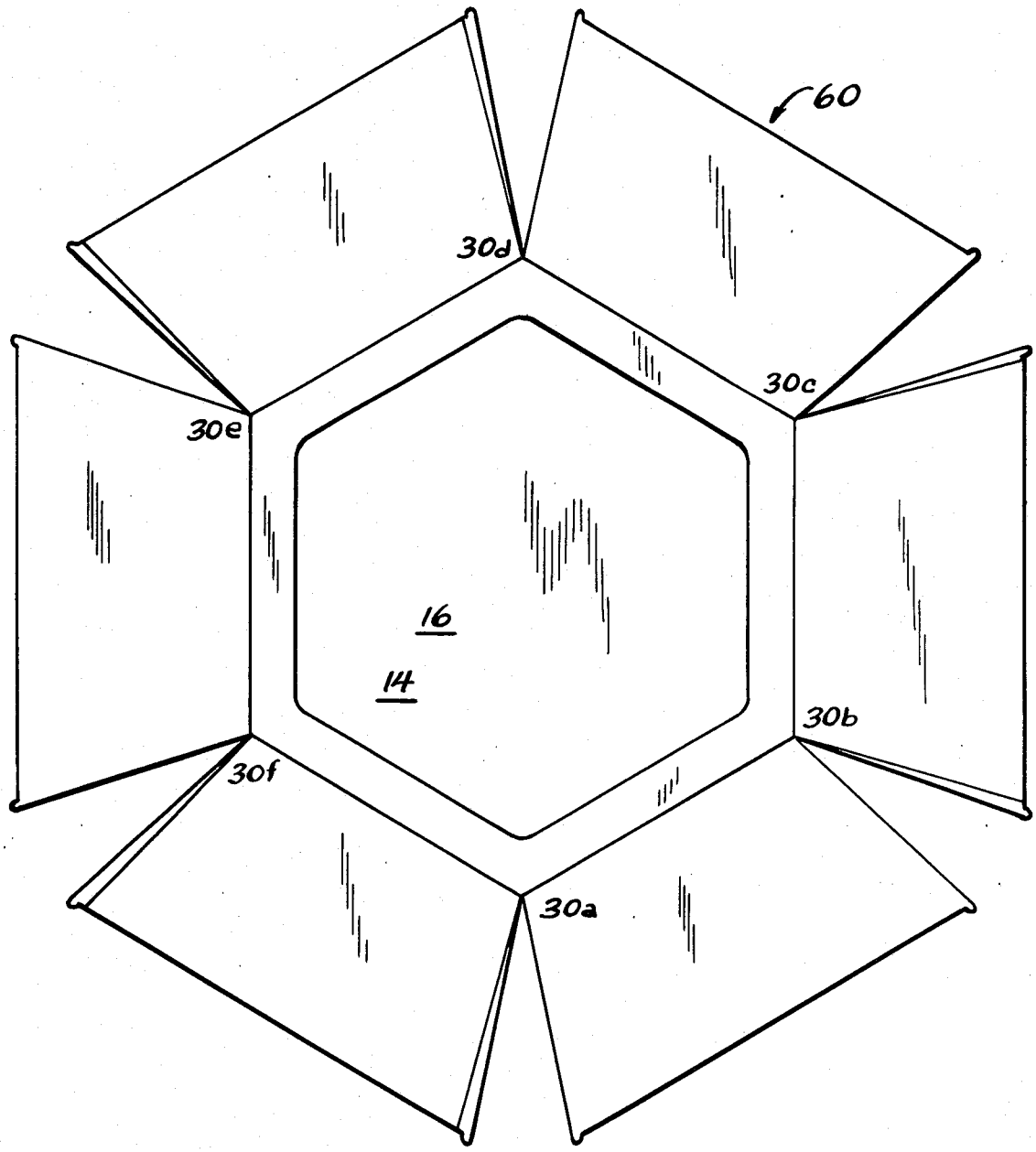
FIG. 4 is a top view of the blank forming the upper portion of the collapsible container.
Figure 5:
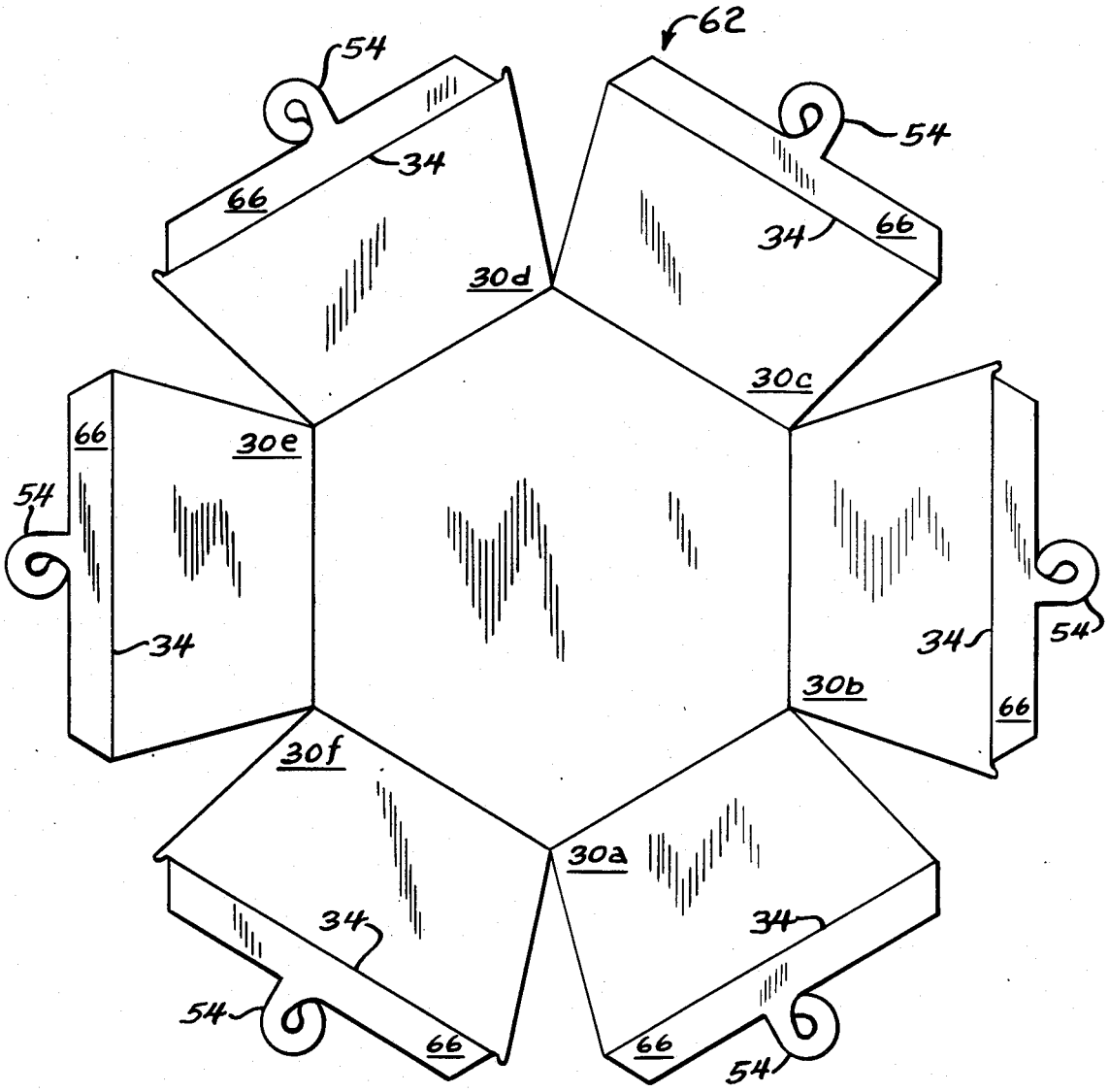
FIG. 5 is a bottom view of the blank forming the bottom portion of the container.

Referring to FIGS. 4 and 5, the blanks that form the collapsible container 10 of this invention are illustrated. The top blank 60 comprises the top panel 12 with six side top sections 30*a, . . . f* extending outward from the edges thereof, the side sections are separated from the top panel by score lines 26 to form the hinged connection. The bottom blank 64 comprises the bottom panel 16 with side bottom sections 32*a, . . . f* similarly hingedly connected by score lines 28. Extending outward from the base of each bottom section is a connecting tab 66 of trapezoidal shape having its base hingedly connected to the bottom section along score line 34. The eye tab 54 extends out from the center of each connecting tab.

To assemble the blanks 60 and 64 into the collapsible container 10, the connecting tabs 66 are folded over, and glued, or otherwise permanently attached, to the interior portions of the base of the side top sections 30*a, . . . f.* This serves to form the hinged connection between the side top and bottom sections, and can be done where the container is manufactured. This allows the containers to be economically and conveniently stored and shipped as a flat one piece unit. When the container is to be assembled all that is necessary is to separate the top and bottom sections until the interlocking tabs 50, 52 engage. The container is then ready for the storage and display of small articles. When use of the container is no longer desired the container may be easily collapsed for flat storage until needed again.

While we have shown and described embodiments of this invention in some detail, it will be understood that this description and illustrations are offered merely by way of example, and that the invention is to be limited in scope only by the appended claims.

What is claimed is:

1. A one piece collapsible container comprising:

(a) a bottom panel of polygonal shape having at least three sides;

(b) a top panel of polygonal shape having the same number of sides as the bottom panel;

(c) a plurality of side panels hingedly secured to said top and bottom panels, respectively, the top side panels also being hingedly connected to the bottom side panels to permit movement between deployed and collapsed positions, said top and bottom side panels folding outwardly to a substantially flat, juxtaposed position when the container is collapsed;

(d) interlocking means carried by said top and bottom side panels for securing top side panels to the bottom side panels in the deployed position.

2. The collapsible container of claim 1 wherein said interlocking means comprise a plurality of tabs on the top and bottom side panels dimensioned to interengage and lock when the container is manipulated from the collapsed position to the deployed position.

3. The collapsible container of claim 1 wherein said top panel has an opening therein to provide access to the interior of the container.

4. The collapsible container of claim 1 further including means for biasing the container to the deployed position.

5. The collapsible container of claim 4, wherein said biasing means comprises a plurality of eyelet tabs positioned in the interior of the container on selected side panels, said tabs adapted to receive and capture a tensioned elastomeric band whereby an inwardly directed biasing force is created and maintained.

* * * * *